United States Patent [19]

Koch

[11] 3,979,826

[45] Sept. 14, 1976

[54] SCISSORS

[75] Inventor: Ulf Koch, Solingen, Germany

[73] Assignee: J.A. Henckels Zwillingswerk Aktiengesellschaft, Solingen, Germany

[22] Filed: Feb. 25, 1976

[21] Appl. No.: 661,289

[30] Foreign Application Priority Data

Mar. 20, 1975 Germany ..... 2512187

[52] U.S. Cl. ..... 30/341; 76/104 A

[51] Int. Cl.[2] ..... B26B 13/12

[58] Field of Search ..... 76/104 A; 30/254, 256, 30/257, 341, 259; 128/318

[56] References Cited

UNITED STATES PATENTS 2,136,414 11/1938 Clements ..... 128/318

2,669,992 2/1954 Curutchet ..... 30/341 X

FOREIGN PATENTS OR APPLICATIONS 1,235,404 5/1960 France ..... 30/254

*Primary Examiner*—Al Lawrence Smith
*Assistant Examiner*—J. C. Peters
*Attorney, Agent, or Firm*—Martin A. Farber

[57] ABSTRACT

A scissors with gripper eyes of elliptical periphery disposed on the scissor handles, as well as to a method for the manufacture of such a scissors. Both of the gripper eyes are formed in the shape of hollow cylinder-inclined section-rings, which are disposed inverted with respect to each other.

6 Claims, 8 Drawing Figures

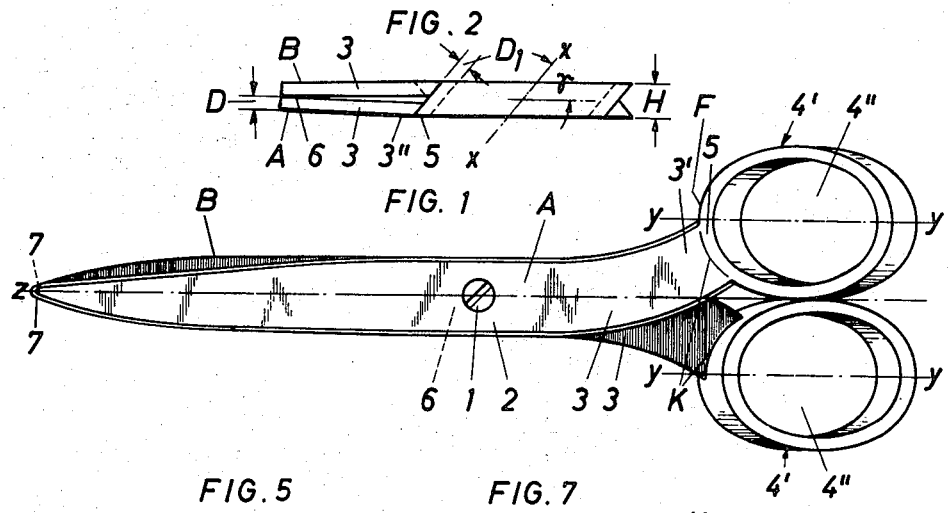
FIG. 2
B
3
D1
x
D
H
A
6
3
3"
5
x
FIG. 1
B
A
7
z
7
6
1
2
3
3
y
y
y
y
K
F
5
3'
4'
4"
4'
4"
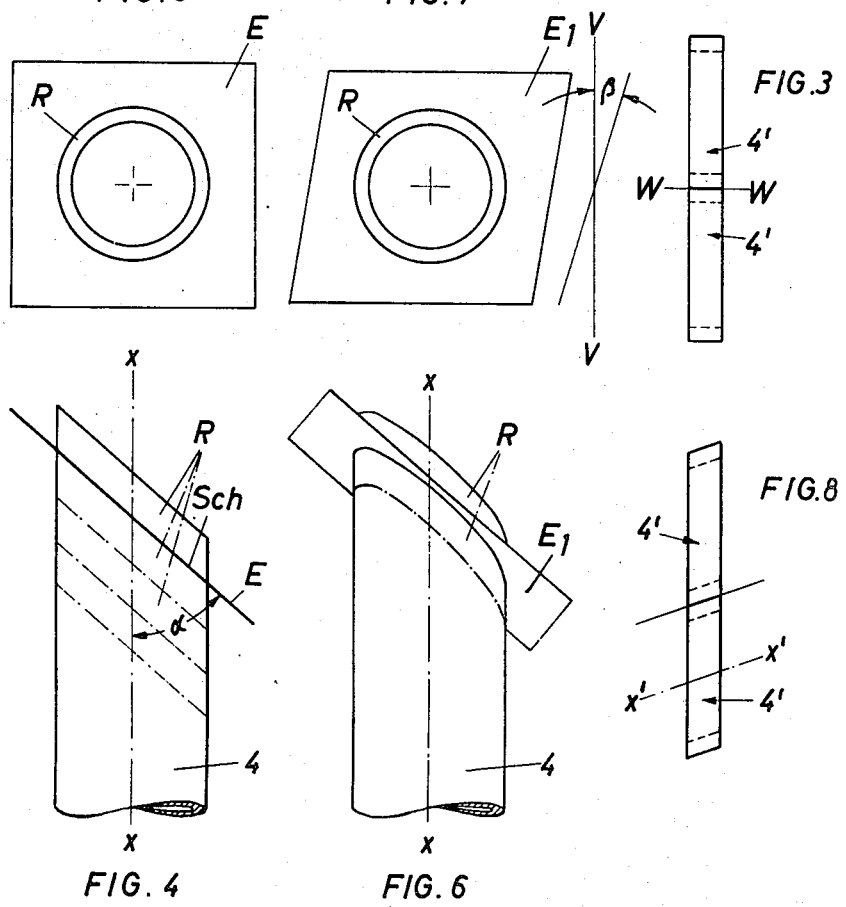
FIG. 5
E
R
FIG. 7
E1
V
R
β
V
FIG. 3
4'
W
W
4'
x
R
Sch
E
α
4
x
FIG. 4
x
R
E1
4
x
FIG. 6
FIG. 8
4'
x'
x'
4'

SCISSORS

The invention relates to a scissors with gripper eyes of elliptical periphery disposed on the scissors handles, as well as to a method for the manufacture of such a scissors.

It is known to form eyes of ring-shaped rolled handle ends or from separate wire sections, and in the latter case to connect same by welding or the like with the handles. Since by such eye rings a mandrel or pin producing a stroke limiting collision of the scissor legs is missing, the scissor handles are off-set or bent at angles in the region between the joint and the eye, so that both eye rings lie in one plane. Construction shapes of this type indeed are price-wise favorable, yet have the disadvantage of too strong a constricting or binding effect since the eyes (manufactured during a hot forging process) offer larger contact surfaces for the thumb and the finger of the operator's hand, whereby particularly, also higher shearing forces can be applied.

It is an object of the invention, particularly, in addition to those objects which may be gathered from the specification and claims, to provide a scissors which has a simple economical production, in spite of an exceptionally hand sympathetic or compatible, eye shape, that is an eye shape optimumly taking into consideration the anatomical proportions of the operator's hand.

In accordance with another object of the invention, the above mentioned object is solved by formation of both of the gripper or handle eyes in the shape of hollow cylinder-inclined section-rings which are arranged inverted with respect to each other.

It is advantageous according to the invention for the exterior surfaces of the handles (or stems) of the scissors to be aligned substantially flush with the rim of the eyes, respectively.

The invention further proposes to orient the longitudinal axis of the ellipsoidal contour of the eye rings substantially parallel to the longitudinal axis of the scissors.

Further it is of advantage in accordance with the invention if the height of the eye rings corresponds substantially to double the thickness of a handle.

An advantageous method for manufacturing such a scissors in accordance with the invention resides in separating individual eye rings from a tube by separating cuts which are inclined relative to the longitudinal axis of the tube, and subsequently securing same with their outer jacket surface on the handle such that one eye ring is oriented in inverted position with respect to the other eye ring.

Still further it is advantageous in accordance with the invention when the separating cut section lies askew or twisted relative to the longitudinal axis of the tube.

In this manner an exceptionally economical scissors manufacture is realized. The fastening of the eyes may be performed economically. The gripper eyes are formed in the shape of hollow cylinder-inclined section-rings. These may be easily produced in a molding method, for example, an injection- or die- molding process, or they may originate from commercially available tubing in which case the individual eye rings are cut into lengths or separating sections which are inclined relative to the longitudinal axis of the tube, and are subsequently secured on the handles. This can be done for example by brazing or hard soldering.

Viewed outwardly from the cutting section plane, elliptical eye rings are formed, although they originate from tubular material of circular cross-section. Considering the usual use practices, with the arrangement of the eye rings in reciprocally inverted position, the anatomical proportions of the user's hand are fully taken into account. The thumb running inclined up to the scissor member plane finds a corresponding stick-in hole or cavity; the second finger holding the lower scissor member running in opposite direction finds likewise the corresponding oppositely aligned stick-in hole or cavity. The inner wall of the eye ring engages the finger with a wide surface. Otherwise occurring painful constrictions on the finger are avoided.

In the manner that the height of the eye ring corresponds substantially to double the thickness of the handle, and besides, the exterior surface of the handle runs substantially flush into the rim of the eye, simultaneously there is achieved a limiting stroke or abutment which prevents the overlapping of the points of the scissors with respect to each other, without the necessity of bending the section between the joint and the eye at right angles, so that particularly with flat wrought or forged scissor material, or scissors made from flat stock, the desired flat character of the scissors is not interfered with. Also an exceptional appearance is present. Advantageously the longitudinal axis of the ellipse of the eye ring extends substantially parallel to the longitudinal axis of the scissors. This measure, above all has application when the eye opening of the lower scissor member is held so large that only one finger can be inserted. Particularly with larger surface scissor types, particularly tailor scissors, where the eye of the lower member is so large that several, particularly two additional fingers of the user's hand ought to have space, the longitudinal axis of the ellipse also converges with respect to the longitudinal axis of the scissor, so that the back-staggered arrangement of the operating fingers is then taken into consideration. Instead of circular tubing, in this case, oval tubing can be used. Particularly with a larger operating hand, it is advantageous if the sections forming the eye rings are separated askew corresponding to the longitudinal axis of the tube; in this way one obtains an inclined course of the eye cavity viewed from the insert side of the fingers. The material band from which the scissor beck member is stamped out can be substantially smaller in surface so that a considerable material reduction occurs. Also an expensive eye grinding, particularly grinding inside the eyes is made unnecessary.

With the above and other objects and advantages in view the invention will become more clearly understood from the following description of preferred embodiments considered in connection with the accompanying drawings, in which:

FIG. 1 is a front elevational view of a scissors made of separately pre-finished scissors members and gripper eyes of the invention;

FIG. 2 is a top plan view of the eye side end portion of this scissors;

FIG. 3 is a side view toward the eye end of the scissors of FIG. 1;

FIG. 4 is a plan view of a tube section illustrating the separating section-course inclined to the tube longitudinal axis for forming gripper eyes in the shape of hollow cylinder-inclined section-rings;

FIG. 5 is a front view toward the tube of FIG. 4;

FIG. 6 is a similar tube illustrating an askew separating section cut relative to the tube longitudinal axis;

FIG. 7 is a front view toward the tube of FIG. 6 respectively with schematically indicated separating cutting plane; and FIG. 8 is a side view toward the eye end of a scissors having eye rings applied from a separating section-course according to FIG. 6.

Referring to the drawings, a scissors comprises an upper beck or member A and a lower beck or member B. These members are equally shaped and are connected to each other by a so called joint bolt 1.

The upper member A and the lower member B continue, following in connection with the joint portion 2, into a comparatively wide stem or handle portion 3, each of the handles 3 terminating with an eye 4'.

The eyes 4' are developed either in a forming or molding method, or by hollow cylinder-inclined section-rings R cut into lengths or sections from a tube 4. In the present example the latter manufacturing type is preferred. The separation section Sch is inclined to the longitudinal axis $x—x$ of the tube 4. The sectioning plane is designated with the reference character E. The acute inclined angle $\alpha$ alpha is preferably approximately 45 degrees. Although a circular tube is used an elliptical ring R arises in appearance.

The height H of each eye ring 4' corresponds approximately to double the thickness D of each member A, B or double the tube wall thickness $D_1$ of a ring, respectively, (compare FIG. 2).

The eye rings 4' are secured on the handle ends 3', respectively, the ends 3' having a flute or channel surface K complementary to the contour of the tube-ring outer jacket surface F, the fastening being, for example, by hard brazing or soldering. The attaching is such that the exterior surface 3'' of the handle 3 of the upper member A is flush with the rim 5 of the eye ring 4'. With a corresponding coordination on the handle 3 of the lower member B, both eye rings 4' project over the intermediary portion 6 such that the eye rings simultaneously form limit abutments preventing the scissor points 7 from over-lapping each other.

With the product (compare particularly FIG. 1) produced according to the method in accordance with the invention, the rings 4' which form an elliptical eye cavity 4'' viewed from the side, are aligned with their ellipse-longitudinal axes $y—y$ (major axes) substantially parallel to the longitudinal axis $z$ of the scissors. Somewhat of a convergence, particularly of that eye ring 4' which is fastened on the lower member B, that is of its ellipse-longitudinal axis $y—y$, would be advantageous if the existing eye ring 4' has a larger eye cavity 4'', for example for the entrance of several fingers of an operator's hand.

The attachment of the eye rings 4', respectively, occur in inverted position, that is the course of the cavity 4'' of the eye ring 4' of the upper member A is inclined (angle $\gamma$ gamma) opposite with respect to the eye cavity 4'' of the eye ring 4' of the lower member B (compare FIG. 2, in which the course of a tube axis $x—x$ is shown). The wall of the hollow cylinder-inclined section-ring 4' is inclined parallel in the range of the narrow ellipse arcs (i.e., those arcs which are intersected by the major axis $y—y$), and changes continuously arriving at the larger or flatter ellipse arcs into a perpendicular alignment, with respect to the section cutting plane, in order finally to come into linear or substantial linear contact with the outer jacket wall of the adjacent ring (as indicated by the horizontal line W—W of FIG. 3).

If in addition to the applied inclination course (angle $\alpha$ alpha), further one skews or twists the separation section cut Sch, that is if one tilts the section plane $E_1$ (FIG. 6) still by the angle $\beta$ beta relative to the vertical V, then the tube-ring axis $x—x$ beyond the inclination position scissors plane also assumes still an inclination position $x'—x'$ (FIG. 8) relative to the horizontal W—W (compare FIG. 3.) Particularly with larger scissors, also here this makes possible a formation taking into consideration the anatomical proportions, and indeed further employs the entire inner wall thickness as an enlarged contact area.

While I have disclosed two embodiments of the invention, it is to be understood that these embodiments are given by example only and not in a limiting sense.

I claim:

1. A scissors with gripper eyes of elliptical periphery on scissor handles, comprising two scissor members pivotally connected to each other and having handle portions, respectively, gripper eyes, constituting sectional cuts of a hollow cylinder forming rings, said sectional cuts being inclined to the longitudinal axis of the cylinder, said rings being secured to said handle portions, respectively, in inverted position with respect to each other.

2. The scissors, as set forth in claim 1, wherein said rings define rims, said handle portions have exterior surfaces, respectively, which each run flush into one of said rims of said rings, respectively.

3. The scissors, as set forth in claim 1, wherein said rings each define an ellipsoidal-longitudinal axis and said scissor members define a scissor-longitudinal axis, said ellipsoidal-longitudinal axis of said rings, respectively, is oriented substantially parallel to said scissor-longitudinal axis.

4. The scissors, as set forth in claim 1, wherein said rings have a height which is substantially equal to double the thickness of one of said handle portions.

5. A method of producing a scissor according to claim 1, comprising the steps of separating individual eye rings from a tube by separating section cuts which are inclined to the longitudinal axis of the tube, thereafter securing said section cuts, respectively, with their outer surfaces on the handles of the scissors with such an orientation of the eye rings that one of said eye rings is in inverted position with respect to another of said eye rings.

6. The method, as set forth in claim 5, further comprising the step of orienting the separating section cuts askew to the longitudinal axis of the tube.

* * * * *